US010662009B2

(12) United States Patent
Hashimoto et al.

(10) Patent No.: US 10,662,009 B2
(45) Date of Patent: May 26, 2020

(54) SHEET FEEDING DEVICE, IMAGE FORMING APPARATUS, AND IMAGE FORMING SYSTEM

(71) Applicants: Masato Hashimoto, Kanagawa (JP); Tatsuya Sugawara, Kanagawa (JP); Hideaki Takahashi, Kanagawa (JP)

(72) Inventors: Masato Hashimoto, Kanagawa (JP); Tatsuya Sugawara, Kanagawa (JP); Hideaki Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/194,938

(22) Filed: Nov. 19, 2018

(65) Prior Publication Data

US 2019/0152730 A1 May 23, 2019

(30) Foreign Application Priority Data

Nov. 22, 2017 (JP) ..... 2017-224955
Aug. 6, 2018 (JP) ..... 2018-147426

(51) Int. Cl.
*B65H 3/48* (2006.01)
*B65H 3/14* (2006.01)
(Continued)

(52) U.S. Cl.
CPC ..... *B65H 3/48* (2013.01); *B65H 1/04* (2013.01); *B65H 3/128* (2013.01); *B65H 3/14* (2013.01); *B65H 3/46* (2013.01); *B65H 5/062* (2013.01); *B65H 2405/15* (2013.01); *B65H 2406/122* (2013.01); *B65H 2406/352* (2013.01); *B65H 2406/3511* (2013.01); *B65H 2406/365* (2013.01); *B65H 2801/06* (2013.01)

(58) Field of Classification Search
None
See application file for complete search history.

(56) References Cited

U.S. PATENT DOCUMENTS 5,259,608 A * 11/1993 Pollich ..... B41F 23/0443 271/183
8,752,822 B2 * 6/2014 Suzuki ..... B65H 3/128 271/11

(Continued)

FOREIGN PATENT DOCUMENTS

JP 64-008140 1/1989
JP 3-216431 9/1991

(Continued)

*Primary Examiner* — Prasad V Gokhale
(74) *Attorney, Agent, or Firm* — Harness, Dickey & Pierce, P.L.C.

(57) ABSTRACT

A sheet feeding device includes a sheet stacking table, an air blower, a feeder, and an air sucker. The sheet stacking table stacks a bundle of sheets. The air blower blows air to the bundle of sheets to float an uppermost sheet from the bundle of sheets. The feeder feeds the uppermost sheet. The air sucker sucks air in such a direction that a sheet in vicinity of the uppermost sheet moves away from the feeder. The air sucker includes a suction nozzle to suck air, a suction fan to generate a negative pressure, a suction duct to communicate the suction nozzle with the suction fan, and an opening-and-closing mechanism to shut off and release ventilation in the suction duct.

12 Claims, 12 Drawing Sheets

(51) Int. Cl.

| | |
|---|---|
| ***B65H 5/06*** | (2006.01) |
| ***B65H 3/12*** | (2006.01) |
| ***B65H 1/04*** | (2006.01) |
| ***B65H 3/46*** | (2006.01) |

(56) References Cited

U.S. PATENT DOCUMENTS

| | | | | |
|---|---|---|---|---|
| 9,926,151 | B2 * | 3/2018 | Takahashi | B65H 3/48 |
| 10,315,870 | B2 * | 6/2019 | Okutsu | B65H 3/14 |
| 2011/0163491 | A1 * | 7/2011 | Suzuki | B65H 3/128 271/5 |
| 2011/0193285 | A1 * | 8/2011 | Kadowaki | B65H 1/14 271/5 |
| 2012/0133092 | A1 | 5/2012 | Fuda et al. | |
| 2014/0339759 | A1 | 11/2014 | Takahashi et al. | |
| 2015/0166280 | A1 | 6/2015 | Hino et al. | |
| 2016/0107854 | A1 | 4/2016 | Hashimoto et al. | |
| 2017/0160689 | A1 | 6/2017 | Sugawara et al. | |
| 2017/0327329 | A1 * | 11/2017 | Takahashi | B65H 3/48 |
| 2018/0237239 | A1 * | 8/2018 | Okutsu | B65H 3/14 |

FOREIGN PATENT DOCUMENTS

| | | | | |
|---|---|---|---|---|
| JP | 8-020451 | | 1/1996 | |
| JP | 9-194061 | | 7/1997 | |
| JP | 10-226426 | | 8/1998 | |
| JP | 2000-203141 | | 7/2000 | |
| JP | 2000-255805 | | 9/2000 | |
| JP | 2001-106391 | | 4/2001 | |
| JP | 2001-233487 | | 8/2001 | |
| JP | 2001-341880 | | 12/2001 | |
| JP | 2005-314114 | | 11/2005 | |
| JP | 2006-008269 | | 1/2006 | |
| JP | 2007-022696 | | 2/2007 | |
| JP | 2007-243875 | | 9/2007 | |
| JP | 2007-331905 | | 12/2007 | |
| JP | 2010-254462 | | 11/2010 | |
| JP | 2011-006176 | | 1/2011 | |
| JP | 2011-162321 | | 8/2011 | |
| JP | 2014-156310 | | 8/2014 | |
| JP | 2016-050093 | | 4/2016 | |
| JP | 2016-078975 | | 5/2016 | |
| JP | 2017210370 | A * | 11/2017 | B65H 3/124 |

* cited by examiner

SHEET FEEDING DEVICE, IMAGE FORMING APPARATUS, AND IMAGE FORMING SYSTEM

CROSS-REFERENCE TO RELATED APPLICATIONS

This patent application is based on and claims priority pursuant to 35 U.S.C. § 119(a) to Japanese Patent Application Nos. 2017-224955, filed on Nov. 22, 2017 and 2018-147426, filed on Aug. 6, 2018, in the Japan Patent Office, the entire disclosure of each of which is hereby incorporated by reference herein.

BACKGROUND

Technical Field

Aspects of the present disclosure relate to a sheet feeding device, an image forming apparatus, and an image forming system.

Related Art

A sheet feeding device is known that blows air to a bundle of sheets stacked on a sheet stacking table to separate the uppermost sheet from the bundle of sheets and feeds the uppermost sheet.

SUMMARY

In an aspect of the present disclosure, there is provided a sheet feeding device that includes a sheet stacking table, an air blower, a feeder, and an air sucker. The sheet stacking table stacks a bundle of sheets. The air blower blows air to the bundle of sheets to float an uppermost sheet from the bundle of sheets. The feeder feeds the uppermost sheet. The air sucker sucks air in such a direction that a sheet in vicinity of the uppermost sheet moves away from the feeder. The air sucker includes a suction nozzle to suck air, a suction fan to generate a negative pressure, a suction duct to communicate the suction nozzle with the suction fan, and an opening-and-closing mechanism to shut off and release ventilation in the suction duct.

In another aspect of the present disclosure, there is provided an image forming apparatus that includes an image forming device to form an image on a sheet and the sheet feeding device to feed the sheet toward the image forming device.

In still another aspect of the present disclosure, there is provided an image forming system that includes an image forming apparatus including an image forming device to form an image on a sheet and the sheet feeding device to feed the sheet toward the image forming apparatus.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
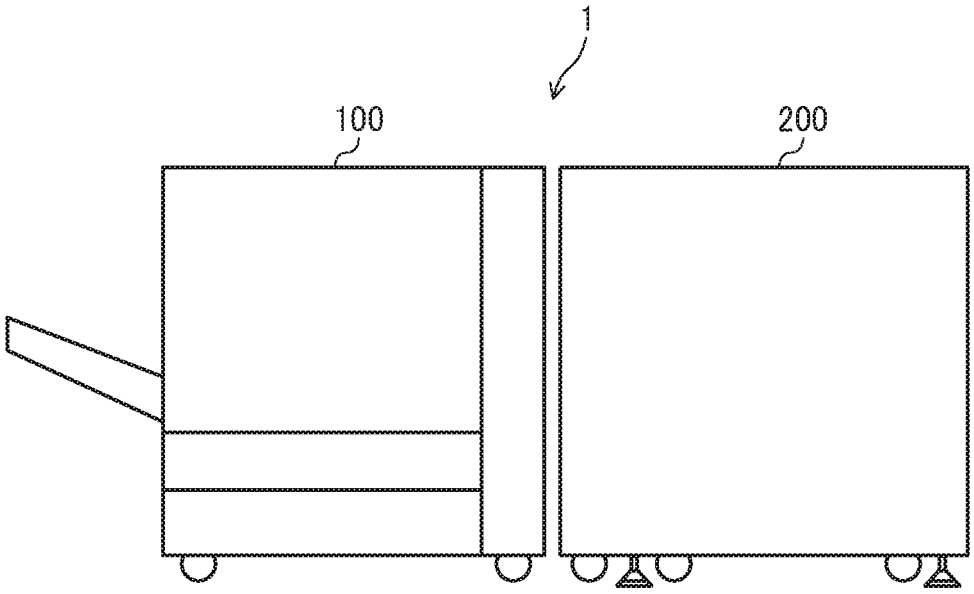
FIG. 1 is a schematic configuration diagram of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure are described with reference to the drawings. In the drawings, the same or corresponding parts are denoted by the same reference numerals, and redundant description thereof are simplified or omitted as appropriate.

Below, a description is given of a sheet feeding device according to an embodiment of the present disclosure. FIG. 1 is a schematic configuration diagram of an image forming system 1 according to the present embodiment. As illustrated in FIG. 1, the image forming system 1 includes an image forming apparatus 100 to form an image on a sheet and a sheet feeding device 200 to feed the sheet to the image forming apparatus 100. The sheet feeding device 200 is disposed on a side surface of an apparatus body of the image forming apparatus 100.

Figure 2:
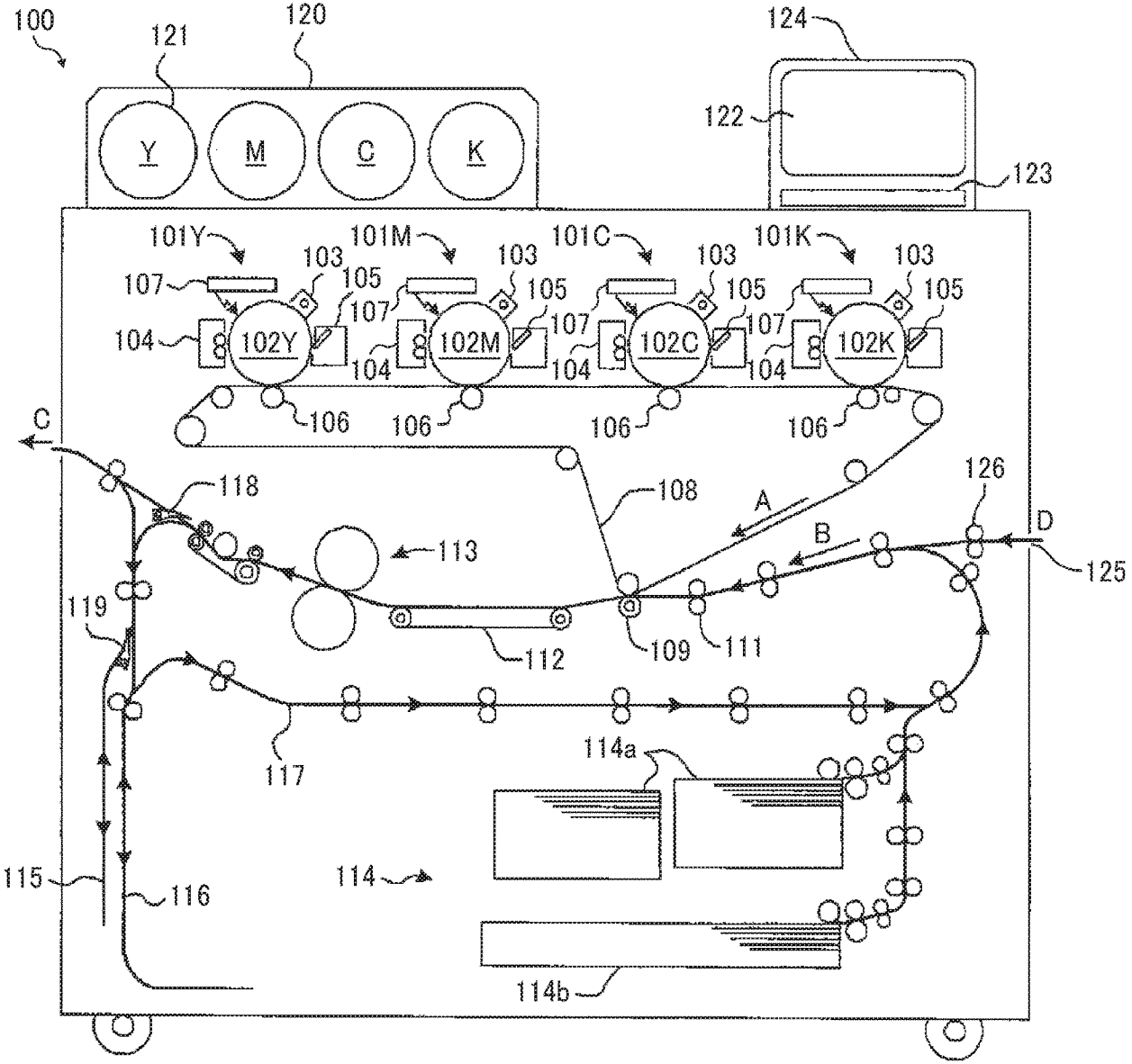
FIG. 2 is a schematic configuration diagram of an image forming apparatus according to an embodiment of the present disclosure.

First, an overall configuration and operation of an image forming apparatus of, for example, an electrophotographic type or an inkjet type to which a sheet feeding device according to the present embodiment can be applied is described with reference to an example of an electrophotographic image forming apparatus. FIG. 2 is a schematic configuration diagram of the image forming apparatus 100 according to the present embodiment. The image forming apparatus 100 is a full color printer using toners of four colors of yellow (Y), magenta (M), cyan (C), and black (K) and a full color copier having an equivalent image forming function. As illustrated in FIG. 2, four image forming units 101Y, 101M, 101C, and 101K as an image forming device to form images with toners of the four colors are arranged side by side on an upper part in the apparatus body. Since the configuration and operation of each of the image forming units 101Y, 101M, 101C, and 101K are substantially the same, the image forming units 101Y, 101M, 101C, and 101K may be representatively referred to as the image forming unit 101 without the codes Y, M, C, and K indicating the colors. In the image forming unit 101, for example, a charger 103, a developing device 104, and a cleaning device 105 are arranged around a photoconductor drum 102 serving as an image bearer. Further, an exposure device 107 is disposed above the photoconductor drum 102.

Below the four image forming units 101Y, 101M, 101C, and 101K, an intermediate transfer belt 108 wound around a plurality of support rollers is disposed. The intermediate transfer belt 108 is driven to travel in a direction indicated by arrow A in FIG. 2 when one of the support rollers is driven by a driver to rotate. A transfer roller 106 as a primary transferor is disposed facing the photoconductor drum 102 of each of the image forming units 101 with the intermediate transfer belt 108 interposed between the transfer roller 106 and the photoconductor drum 102.

In each image forming unit 101, the photoconductor drum 102 (photoconductor drum 102Y, 102M, 102C, or 102K) is driven to rotate counterclockwise in FIG. 2, and the surface of the photoconductor drum 102 is uniformly charged to a predetermined polarity by the charger 103. Subsequently, the charged surface is irradiated with a light-modulated laser beam emitted from the exposure device 107. Thus, an electrostatic latent image is formed on the photoconductor drum 102. The electrostatic latent image is developed with toner applied from the developing device 104 and visualized as a toner image. The toner images of yellow, magenta, cyan, and black formed by the image forming units 101Y, 101M, 101C, and 101K are sequentially superimposed and transferred onto the intermediate transfer belt 108.

On the other hand, a feeding unit 114 including accommodating trays 114*a* and 114*b* is disposed in a lower part of the apparatus body. For example, a sheet, such as transfer paper, is fed from either the feeding unit 114 or the sheet feeding device 200, which is described later, attached to the image forming apparatus 100. The fed sheet is conveyed toward registration rollers 111 in a direction indicated by arrow B in FIG. 2.

The sheet hit against the registration rollers 111 and temporarily stopped is delivered from the registration rollers 111 in timing with the toner image on the intermediate transfer belt 108, and sent into a secondary transfer portion at which the secondary transfer roller 109 and the intermediate transfer belt 108 contact each other. A voltage having a polarity opposite to a charge polarity of the toner is applied to the secondary transfer roller 109, thus causing the superimposed toner image (full color image) on the intermediate transfer belt 108 to be transferred onto the sheet. The sheet, on which the toner image has been transferred, is conveyed to a fixing device 113 by a conveying belt 112, and the toner is fixed on the sheet under heat and pressure in the fixing device 113. The sheet, on which the toner image has been fixed, is ejected to an outside of the apparatus body as indicated by arrow C in FIG. 2 and ejected onto an ejection tray.

When the sheet is ejected with a back side of the sheet facing up (face-down ejection) in simplex printing, the sheet is ejected to the outside of the apparatus body via a sheet reversing section 115 as indicated by arrow C in FIG. 2. Thus, the front side and the back side of the sheet are reversed. In duplex printing, the sheet, on which the toner image has been fixed, is re-fed from a refeeding path 117 to the registration rollers 111 via a duplex reversing section 116, and the toner image is transferred from the intermediate transfer belt 108 to the back side of the sheet. After the toner image has been transferred onto the sheet, the toner image is fixed on the sheet in the fixing device 113. As in the simplex printing, the sheet is ejected to the outside of the apparatus body from the fixing device 113 or via the sheet inverting portion 115 as indicated by arrow C in FIG. 2 and ejected onto the ejection tray. Switching claws 118 and 119 are appropriately arranged to switch a sheet conveyance direction.

In monochrome printing, the image forming apparatus 100 according to the present embodiment forms a toner image using only the black image forming unit 101K and transfers the toner image onto the sheet via the intermediate transfer belt 108. The handling of the sheet after the fixing of the toner image is the same as in the case of full-color printing.

A toner bottle setting section 120 is disposed on an upper surface of the apparatus body of the image forming apparatus 100 to set toner bottles 121 containing toner of the four colors to be supplied to the developing devices 104 of the image forming units 101. An operation unit 124 having a display unit 122 and an operation panel 123 is also disposed on the upper surface of the apparatus body of the image forming apparatus 100. Further, a sheet inlet portion D is disposed on the right side surface of the apparatus body in FIG. 2 to introduce a sheet from the sheet feeding device 200 (see FIG. 3) described below. An opening 125 to introduce the sheet and a conveyor 126 to convey the sheet are disposed at the sheet inlet portion D.

Figure 3:
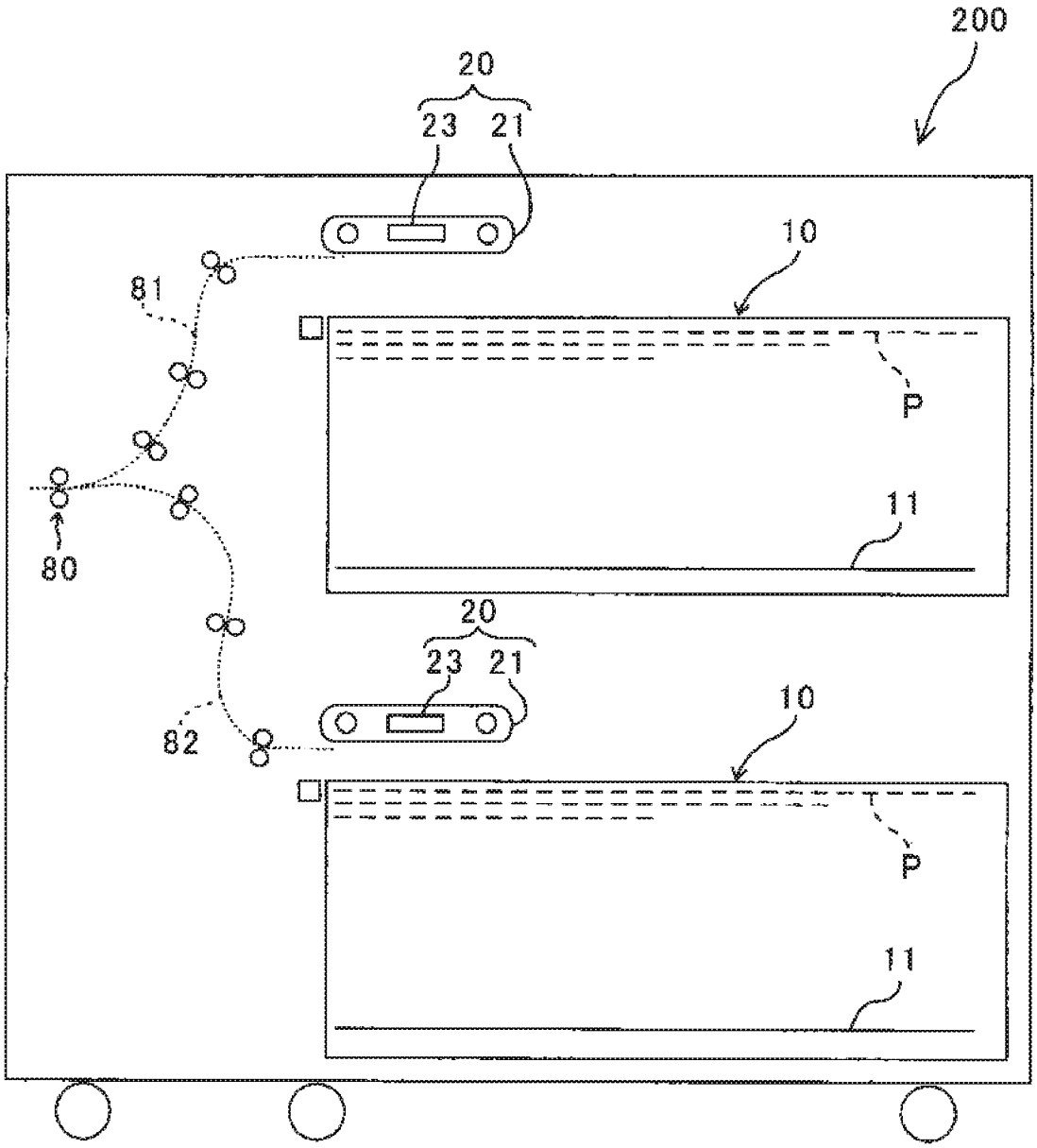
FIG. 3 is a schematic view of a sheet feeding device according to an embodiment of the present disclosure, which is disposed on a side surface of an apparatus body of the image forming apparatus of FIG. 2.

FIG. 3 is a schematic view of the sheet feeding device 200 according to the present embodiment, which is disposed on a side surface of the apparatus body. As illustrated in FIG. 3, the sheet feeding device 200 includes two-stage, upper and lower, accommodating trays 10. Each of the accommodating trays 10 includes the sheet stacking table 11 on which a bundle of sheets P is stacked. In the present embodiment, each accommodating tray 10 can accommodate a maximum of about 2,500 sheets. Note that examples of the sheet include paper, coated paper, label paper, an overhead projector (OHP) sheet, a film, and a prepreg. The prepreg is mainly used as a material for a laminated board or a multilayer printed wiring board. For example, a long resin base material, such as glass cloth, paper, non-woven fabric, or aramid cloth, is continuously impregnated with a resin varnish mainly composed of a thermosetting resin, such as an epoxy resin or a polyimide resin. The long resin material is heated, dried, and cut, and is thus processed into a sheet material. A feeding unit 20 is disposed above each of the accommodating trays 10, to separate and feed the sheets stacked on the accommodating tray 10. Each feeding unit 20 includes an attraction belt 21 as a conveyor and an upward suction device 23.

The sheets stacked on the lower accommodating tray 10 are conveyed to the apparatus body of the image forming apparatus 100 by an exit roller pair 80 through a lower conveyance path 82. The sheets stacked on the accommodating tray 10 at the upper side are conveyed to the apparatus body of the image forming apparatus 100 by the exit roller pair 80 through the upper conveyance path 81.

Figure 4:
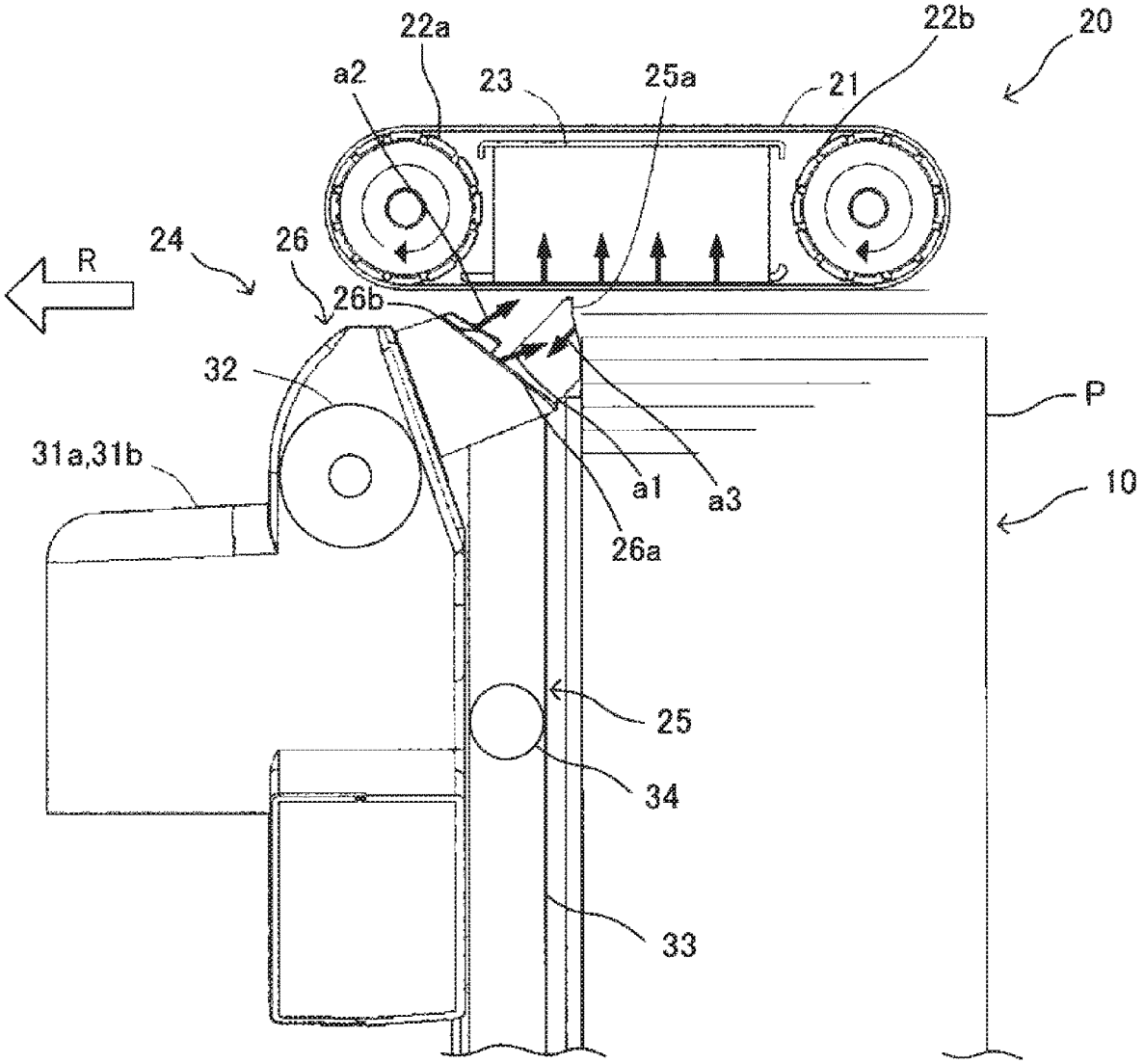
FIG. 4 is a schematic side view of the sheet feeding device of FIG. 3.
Figure 5:
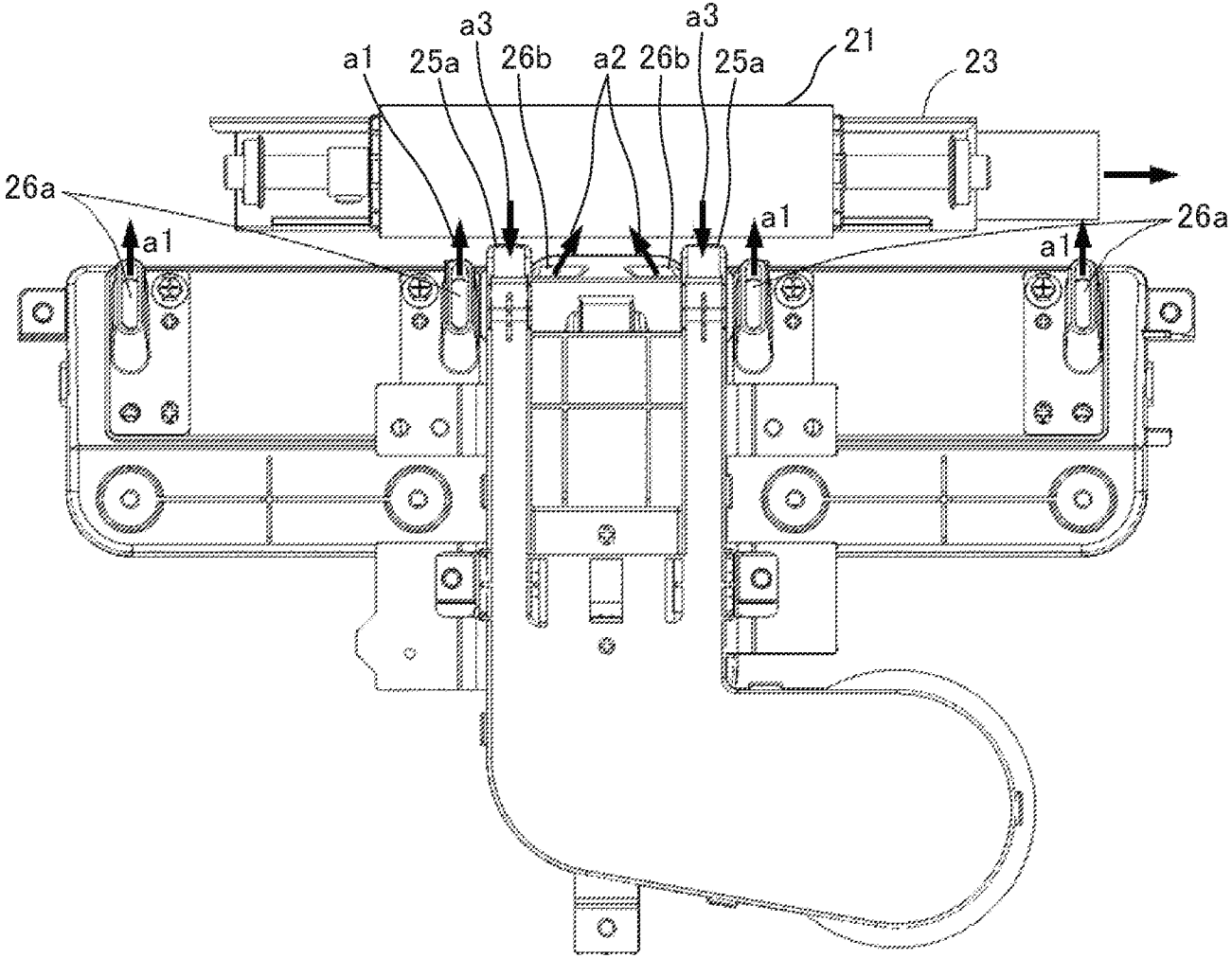
FIG. 5 is a schematic front view of the sheet feeding device of FIG. 3.
Figure 6:
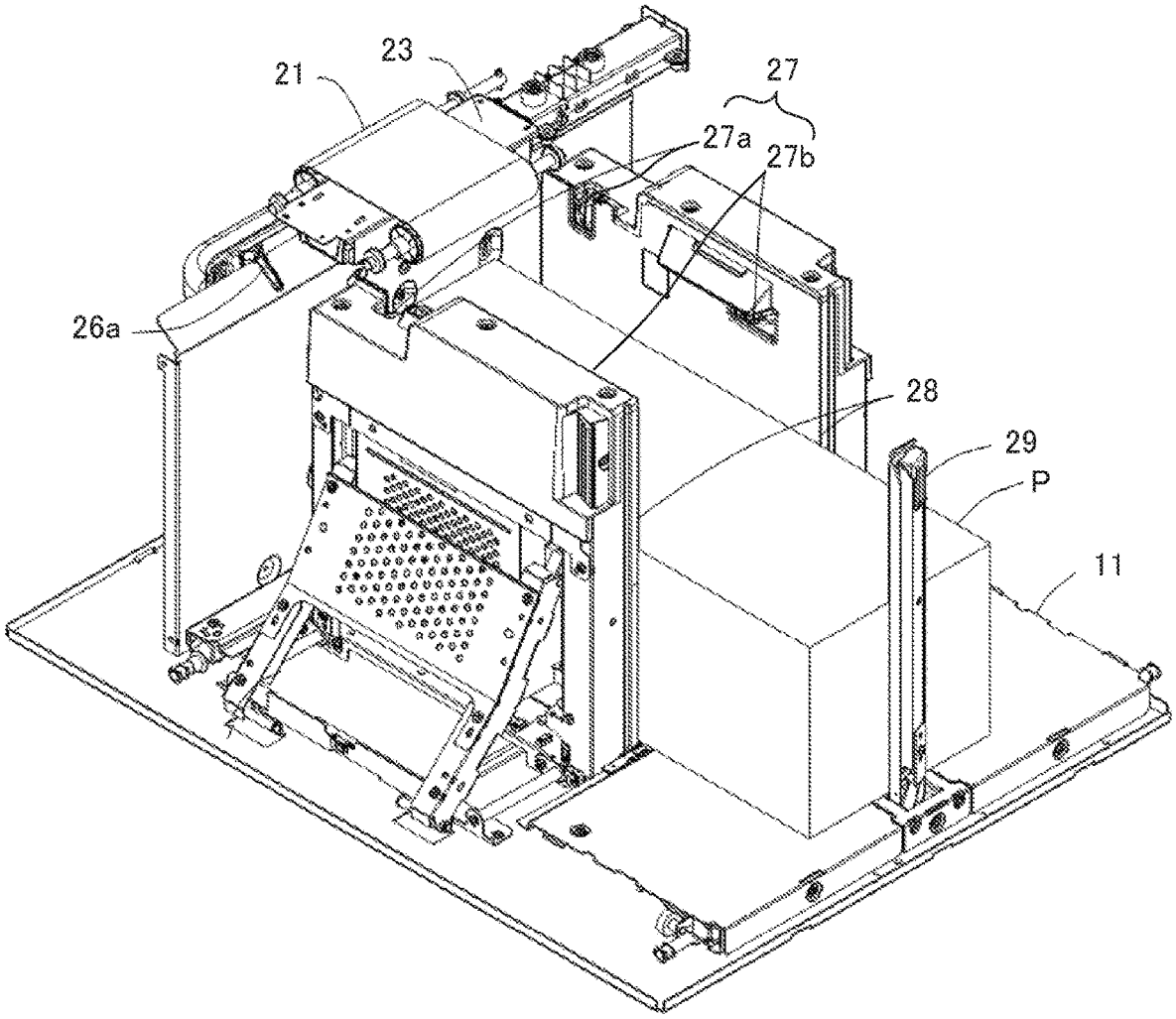
FIG. 6 is a schematic perspective view of the sheet feeding device of FIG. 3.
Figure 7:
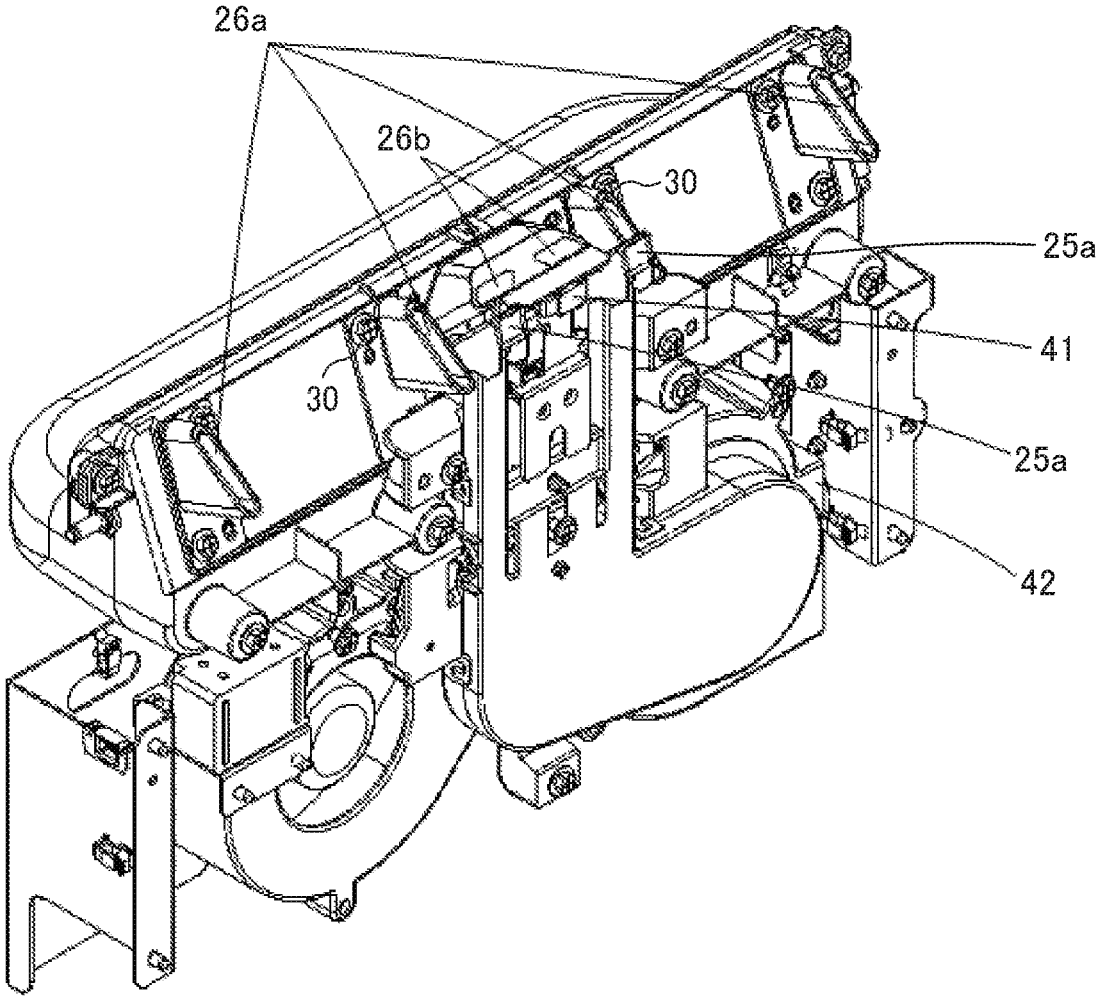
FIG. 7 is a schematic perspective view of a blower and a downward suction device.

FIG. 4 is a schematic side view of the sheet feeding device 200 according to the present embodiment. FIG. 5 is a schematic front view of the sheet feeding device 200 of FIG. 4. FIG. 6 is a schematic perspective view of the sheet feeding device 200 of FIG. 4. FIG. 7 is a schematic perspective view of an air blower and the downward suction device. As illustrated in FIG. 4, the attraction belt 21 of the feeding unit 20 serving as a sheet feeder is stretched over two tension rollers 22*a* and 22*b*. The attraction belt 21 includes suction holes in the entire region in the circumferential direction of the attraction belt 21. The suction holes penetrate through the front surface side to the back surface side of the attraction belt 21. The upward suction device 23 is disposed inside the attraction belt 21. The upward suction device 23 is connected to an upward suction fan to suck air through an air duct that is a flow passage of air and generates a negative pressure downwardly by the upward suction device 23 to attract the sheet onto the lower surface of the attraction belt 21.

The accommodating tray 10 is provided with an air blowing device 24 as an air blowing device to blow air onto an upper portion of the bundle of sheets P and a downward suction device 25 as an air sucking device to suck air in the vicinity of the upper portion of the bundle of sheets P.

The air blowing device 24 includes a front air blower 26 and a side air blower 27. As illustrated in FIGS. 4 and 5, the front air blower 26 blows air to a leading end of the bundle of sheets P (a downstream end of the bundle of sheets P in a feed direction indicated by arrow R in FIG. 4). The front air blower 26 includes a floating nozzle 26*a* and a separation nozzle 26*b*. The floating nozzle 26*a* blows air in a direction to float upper sheets of the bundle of sheets P. The separation nozzle 26*b* blows air to the attraction belt 21 and causes the air to reflect the attraction belt 21 so that other sheets except for the uppermost sheet are directed downward and separated from the uppermost sheet as a first sheet. The air blowing device 24 includes a floating air chamber 31*a* communicating with the floating nozzle 26*a* and a separation air chamber 31*b* communicating with the separation nozzle 26*b*. A float-and-separation shutter 32 is disposed inside the floating air chamber 31*a* and the separation air chamber 31*b* to instantaneously block and release the ventilation in the floating air chamber 31*a* and the separation air chamber 31*b*.

Blowing fans are disposed in the floating air chamber 31*a* and the separation air chamber 31*b*, respectively, to send air. The air blown from the floating nozzle 26*a* in a direction indicated by arrow a1 in FIG. 4 is referred to as front floating air and the air blown from the separation nozzle 26*b* in a direction indicated by arrow a2 is referred to as separation air. The floating air and the separation air are discharged from positions facing a leading end (a downstream end portion in the feed direction) of the bundle of sheets P and are blown to the leading end (the downstream end in the feed direction) of the bundle of sheets P.

Further, as illustrated in FIG. 6, the side air blower 27 is disposed in a pair of side fences 28 that positions to maintain the sheets in a state of not skewing in a width direction corresponding to a direction perpendicular to the feed direction. In the sheet feeding device 200, both of the side fences 28 are moved in the width direction according to the sheet size while referring to a center position of the sheet feeding device 200. The side fences 28 are provided with the side air blower 27 to strike the air in the vicinities of upper lateral sides of the bundle of sheets P to float and separate the sheet.

The side air blower 27 includes front lateral-side floating nozzles 27*a* and rear lateral-side floating nozzles 27*b*. The front lateral-side floating nozzles 27*a* are arranged to face front sides of lateral sides of the sheet in the feed direction and guide air in a direction to separate and float the bundle of sheets P. The rear lateral-side floating nozzles 27*b* are arranged to face rear sides of the lateral sides of the sheet in the feed direction. Air blown from the front lateral-side floating nozzles 27*a* and rear lateral-side floating nozzles 27*b* is referred to as side floating air. The side floating air is discharged from discharge ports. Each discharge port is disposed in each side fence 28 at a position at which the side fence 28 faces an upper portion of the bundle of sheets P. The side floating air is blown onto the side surface of the upper portion of the bundle of sheets P. The air blown from the nozzles of the front air blower 26 and the side air blower 27 floats upper sheets of the bundle of sheets P. As illustrated in FIG. 6, the accommodating tray 10 is provided with an end fence 29 to align the rear end of the bundle of sheets P stacked on the sheet stacking table 11.

As illustrated in FIGS. 4, 5 and 7, the downward suction device 25 sucks air in the vicinity of the front end of the upper portion of the bundle of sheets P downward to generate a negative pressure, thus causing a force acting in a direction away from the attraction belt. The downward suction device 25 includes downward suction nozzles 25*a* and a downward suction air chamber 33. The downward suction nozzles 25*a* suck air in the vicinity of the front end of the upper portion of the bundle of sheets P downward. The downward suction air chamber 33 communicates with the downward suction nozzles 25*a*. The downward suction air chamber 33 includes a downward suction fan 42 that is a suction device to suck air. A downward suction shutter 34 is disposed inside the downward suction air chamber 33. The downward suction shutter 34 is an opening-and-closing mechanism to momentarily switching on and off of the ventilation in the downward suction air chamber 33.

As illustrated in FIG. 7, the sheet feeding device 200 includes a sheet top sensor that is a sheet height detector to detect the height of an upper surface of the uppermost sheet. The sheet top sensor 41 is disposed upstream from the attraction belt 21 in the feed direction.

In the sheet feeding device 200, the distance between the upper surface of the uppermost sheet in the accommodating tray 10, in which the number of sheets decreases with sheet feeding, and the lower surface of the attraction belt is kept within a certain range. Hence, the sheet feeding device 200 detects the height of the upper surface of the uppermost sheet with the sheet top sensor 41, and controls, based on a detection signal of the sheet top sensor 41, a bottom-plate lift motor as a driving source of a lift to vertically move the bottom plate of the accommodating tray 10. Such a configuration can control the height of the bottom plate so that the distance between the upper surface of the uppermost sheet of the bundle of sheets P placed on the bottom plate and the bottom surface of the attraction belt 21 falls within a certain range.

Further, the accuracy of the stop position in the height direction of the sheet stacking table 11 detected by the sheet top sensor 41 can be enhanced for the following reason (see FIG. 7). That is, the detection of the stop position at the time of raising and lowering the sheet stacking table 11 is performed with the upper surface of the sheet and the sheet top sensor 41. When air enters between sheets and the sheets are floating, the accurate detection of the upper surface may not be performed. Hence, the front floating air and the separation air are blocked with the shutter to drop the sheets, thus allowing accurate detection of the upper surface of the uppermost sheet. Instead of the upstream side of the attraction belt 21 in the feeding direction, the sheet top sensor 41 may be disposed on a lateral side of the attraction belt 21 orthogonal to the feed direction. Alternatively, a plurality of sheet top sensors 41 may be disposed on lateral sides of the attraction belt 21 orthogonal to the feed direction.

Figure 8:
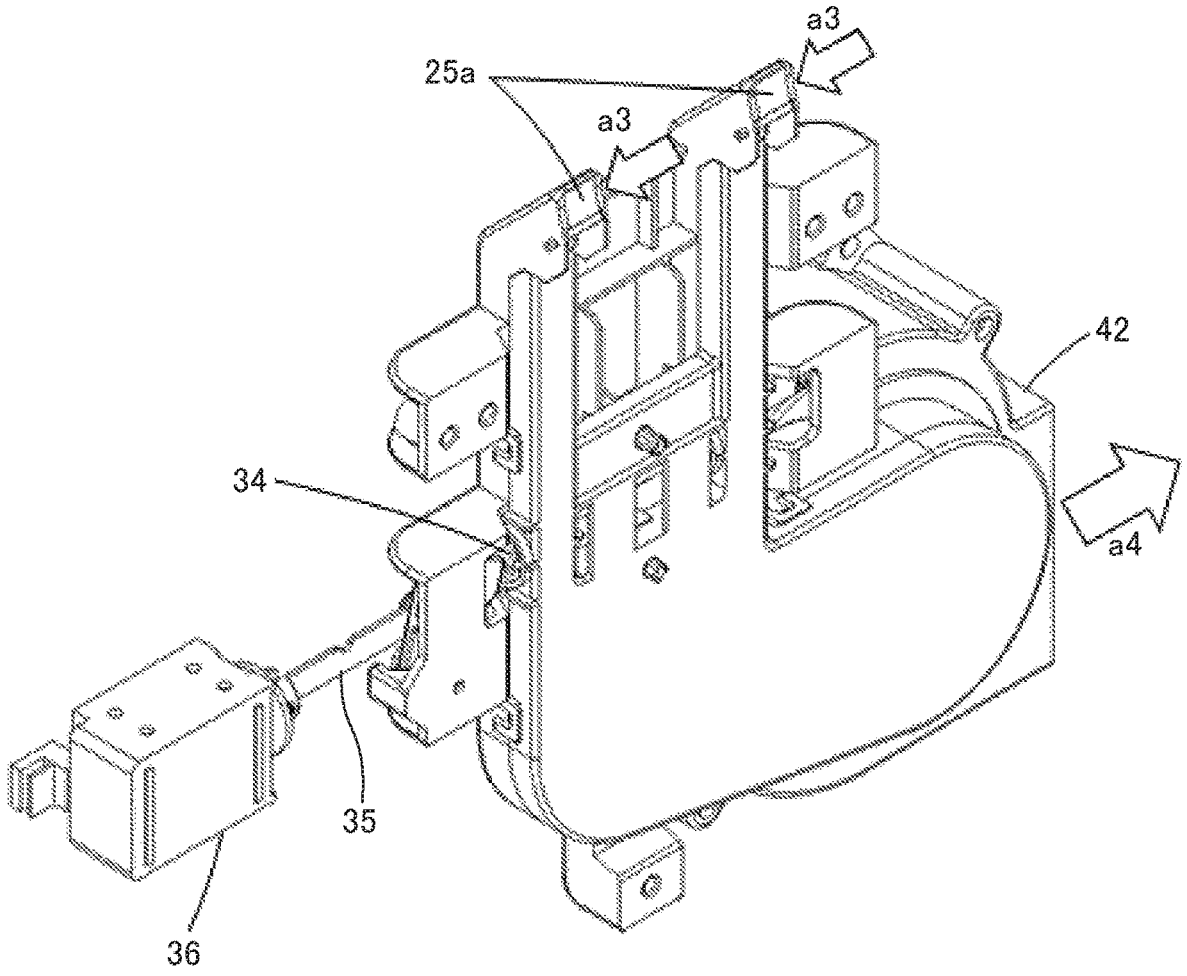
FIG. 8 is a perspective view of the downward suction device seen from the front side of the downward suction device.
Figure 9:
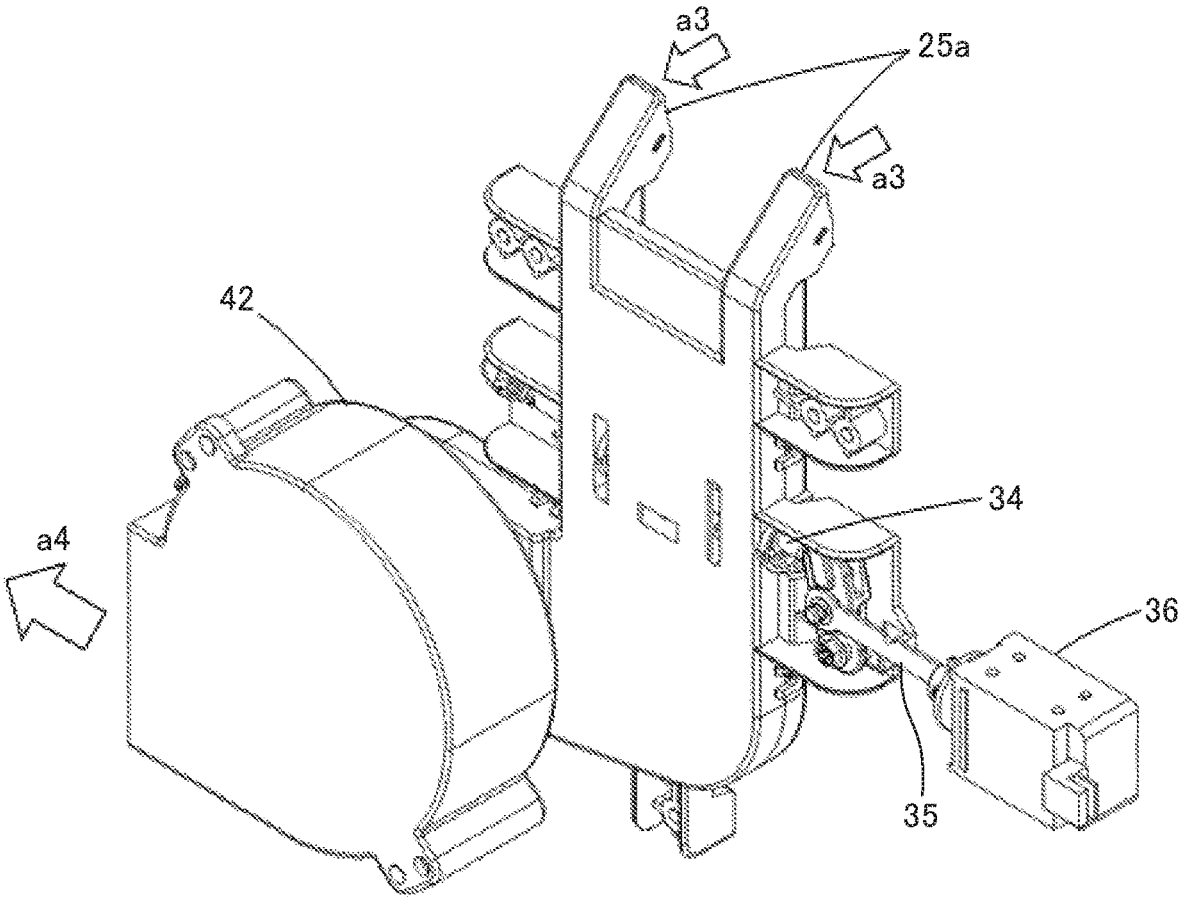
FIG. 9 is a perspective view of the downward suction device seen from the back side of the downward suction device.
Figure 10:
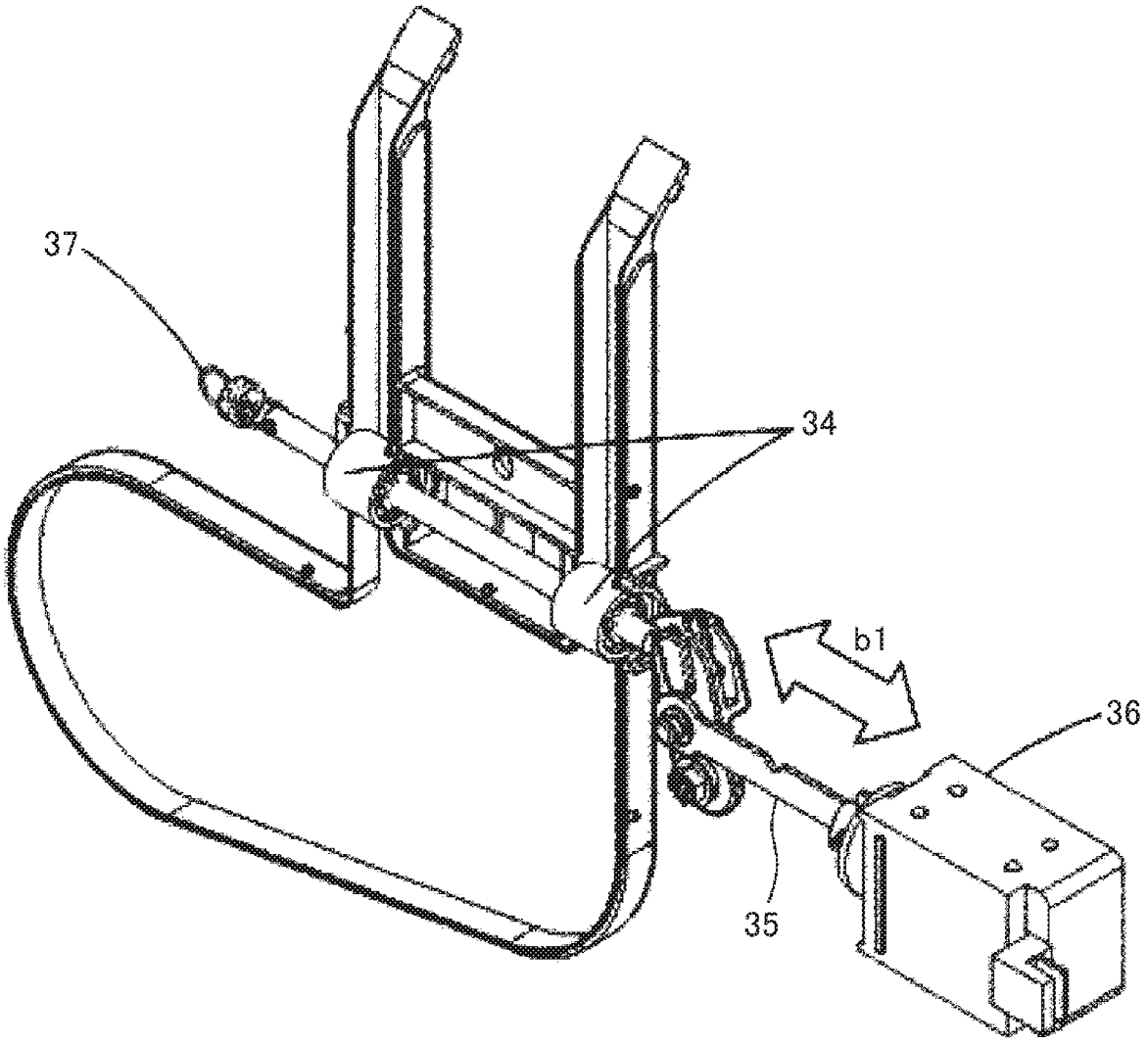
FIG. 10 is a schematic perspective view of a configuration of a suction shutter.

FIG. 8 is a perspective view of the downward suction device 25 seen from the front side of the downward suction device 25. FIG. 9 is a perspective view of the downward suction device 25 seen from the back side of the downward suction device 25. FIG. 10 is a schematic perspective view of a configuration of the downward suction shutter 34. As illustrated in FIGS. 8, 9 and 10, the downward suction nozzle 25*a* sucks air at the vicinity of the front end of the upper portion of the bundle of sheets P downwardly by the negative pressure generated by the downward suction fan 42 so that the vicinity of the front end of the upper portion of the bundle of sheets P have a negative pressure. Two of the downward suction nozzles 25*a* are arranged between the floating nozzle 26*a* and the separation nozzle 26*b*. Further, the downward suction nozzles 25*a* are disposed to contact a leading end of a sheet to be fed subsequently to the uppermost sheet, to regulate feeding of the sheet in the height direction, and also has a function as a blocking plate to hold a leading end of a second sheet (another sheet) and suppress double feeding of a first sheet (uppermost sheet) and the second sheet. Even when the second sheet is about to be fed along with the first sheet, projecting ends of the downward suction nozzles 25*a* contact the leading end of the second sheet, thus reducing double feeding.

Further, the projecting end of the downward suction nozzle 25*a* is disposed to suck the uppermost sheet at a position close to the uppermost sheet in the height direction. Accordingly, it is more effective to reduce the gap between the downward suction nozzle 25*a* and the attraction belt 21 since the separation effect is enhanced when the downward suction nozzles 25*a* suck the uppermost sheet at positions closer to the uppermost sheet. However, since a gap through which the uppermost sheet can pass is also needed, the gap is preferably about 1 mm to about 3 mm. The gap is adjusted by the height of the downward suction nozzle 25*a* with mounting screws 30 as adjuster. In addition, since the side surfaces and the upper surface of the projecting end of the downward suction nozzle 25*a* contacts a sheet, which may be worn and deteriorate. Hence, surface treatment or processing, such as metal plating, to reduce abrasion may be performed on the side surfaces and the upper surface of the projecting end of the downward suction nozzle 25*a*, thus allowing extension of the product life.

In the suction with the downward suction nozzles 25*a*, a solenoid 36 reciprocally moves a pulling shaft 35 in directions indicated by arrow b in FIG. 10, thus switching opening and shutting of the downward suction shutter 34. The downward suction shutter 34 is coupled to the solenoid 36 via the pulling shaft 35. A controller 60 controls turn-on and -off of the solenoid 36 to switch shutting-off and opening of suction air in the downward suction air chamber 33. For example, in a state in which the solenoid 36 is not energized and the attraction force of the solenoid 36 is not acting, that is, OFF state, the downward suction shutter 34 is in a state in which the downward suction shutter 34 is pulled by a spring 37. As a result, a shut-off state in which the downward suction shutter 34 is horizontally disposed with respect to a direction of air suction is obtained.

On the other hand, in a state in which the solenoid 36 is energized and the attraction force of the solenoid 36 is acting to completely suck air, that is, ON state, the downward suction shutter 34 slides toward the solenoid 36 and the air sucked downwardly by the downward suction fan 42 opens the ventilation in the downward suction air chamber 33. When the downward suction fan 42 is driven in such a state, downward suction air flows from the downward suction nozzle 25*a* in a direction indicated by arrow a3 in FIG. 9 and is discharged in a direction indicated by arrow a4 in FIG. 9.

Figure 11:
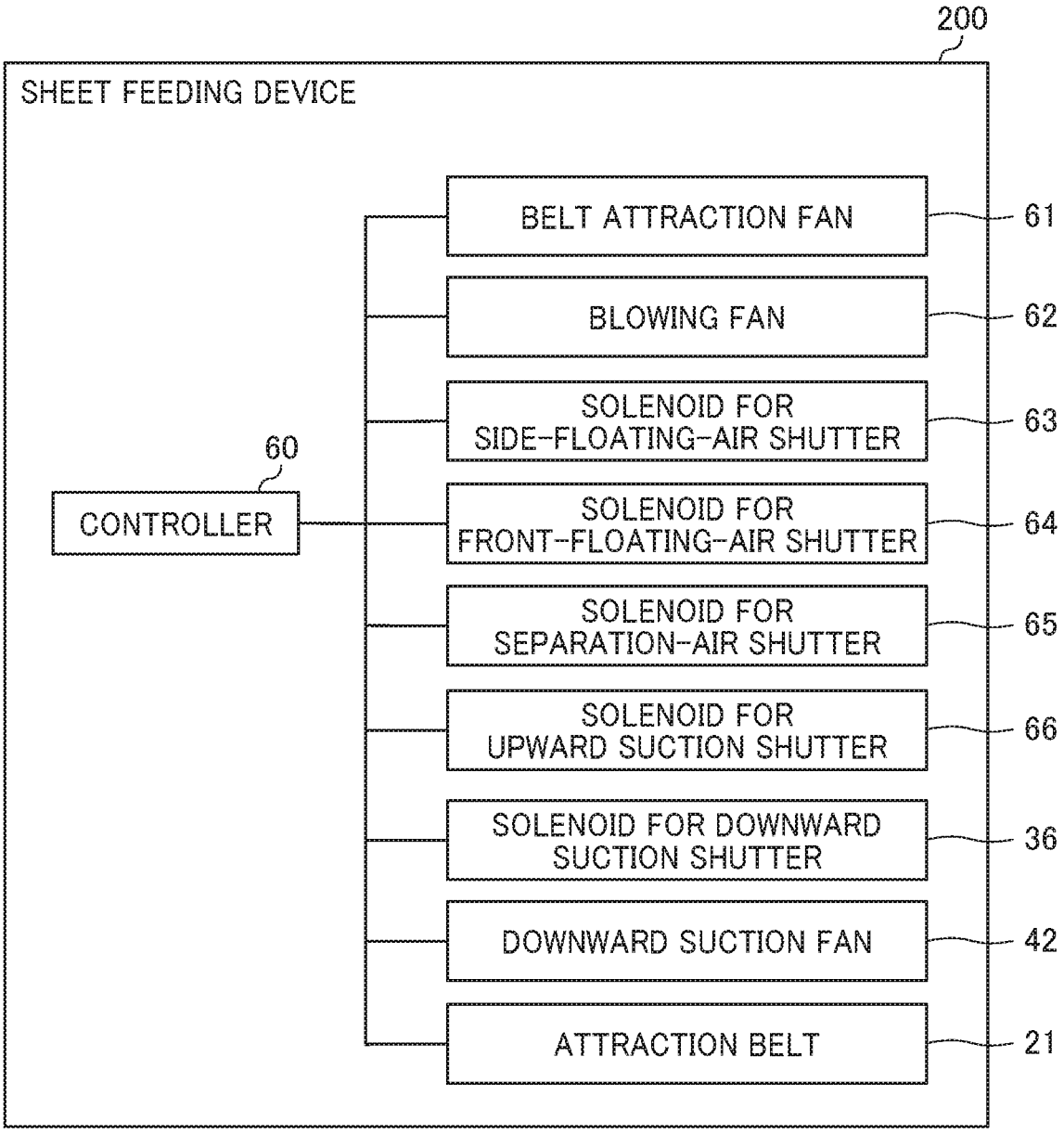
FIG. 11 is a block diagram of an example of a configuration of a portion of a control system in the sheet feeding device of FIG. 3.

Next, a description is given of the feeding control according to the present embodiment. FIG. 11 is a block diagram of an example of a configuration of a control system in the sheet feeding device 200 according to the present embodiment. As illustrated in FIG. 11, the controller 60 as control circuitry of the sheet feeding device 200 is connected to a belt attraction fan 61 that generates a negative pressure to attract a sheet to the attraction belt 21, a blowing fan 62 that blows air toward each of the front air blower 26 and the side air blower 27, a solenoid 63 that operates a side floating air shutter, a solenoid 64 that operates a front floating air shutter, a solenoid 65 that operates a separation air shutter, a solenoid 66 that operates an upward suction shutter, a solenoid 36 that operates a downward suction shutter, a downward suction fan 42 of the downward suction device 25 that sucks air in the vicinity of the upper portion of the bundle of sheets P, and the attraction belt 21.

Figure 12:
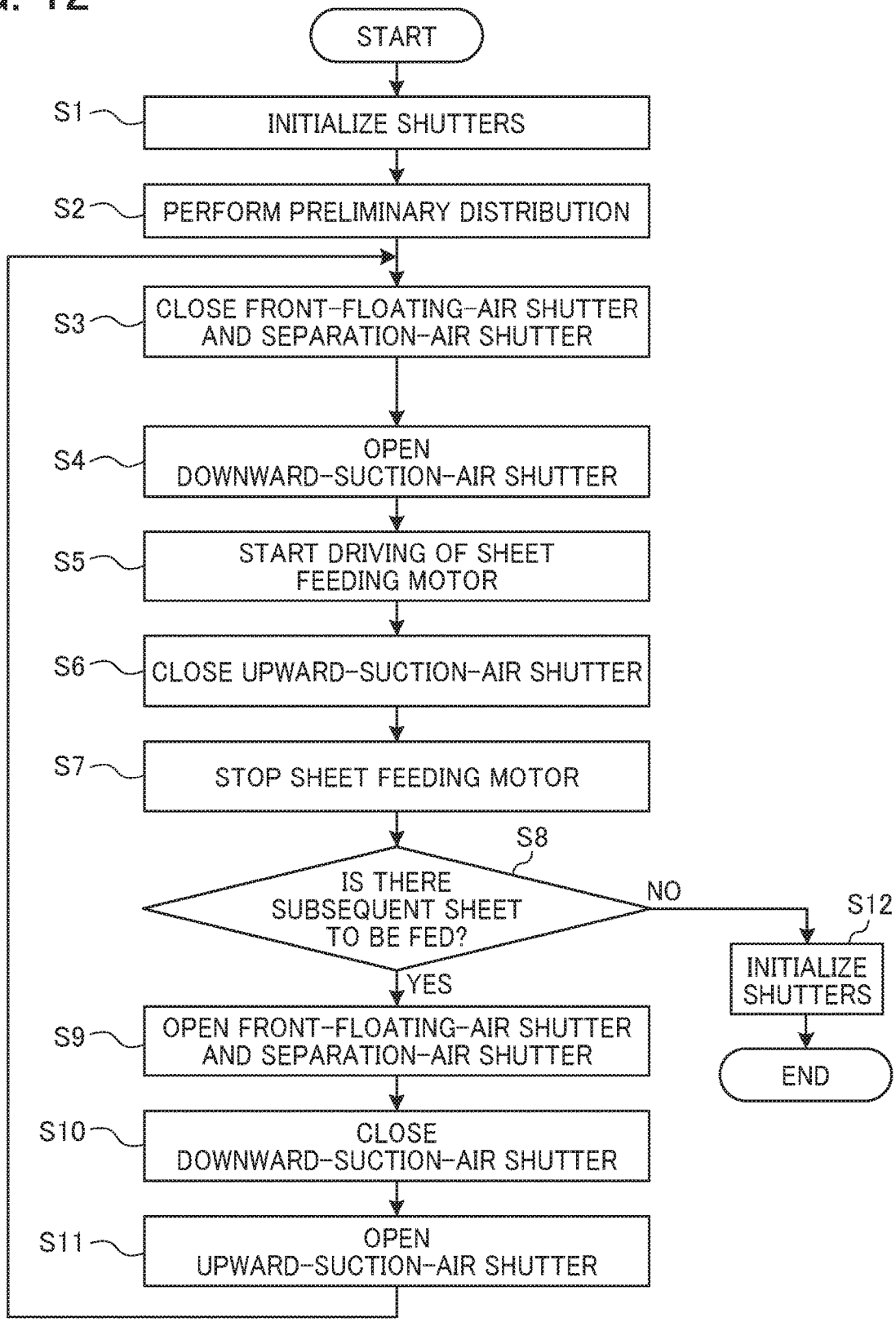
FIG. 12 is a flowchart of an example of feeding operation in the sheet feeding device of FIG. 3.

Next, a description is given of an operation of the sheet feeding device to feed sheets one by one. FIG. 12 is a flowchart of an example of a feeding operation in the sheet feeding device 200 according to the present embodiment. A host controller of the image forming apparatus 100 receives an image forming instruction using a sheet set in the accommodating tray 10 of the sheet feeding device 200 through, for example, an operation unit of the image forming apparatus 100 (see FIG. 4). Then, the host controller transmits a feeding instruction and information, such as the type of the sheet stacked on the sheet stacking table 11 of the accommodating tray 10, to the controller 60 of the sheet feeding device 200 (see FIG. 11). Receiving the feeding instruction, the controller 60 checks whether each of the side floating air shutter, the front floating air shutter, the separation air shutter, the upward suction air shutter, and the downward suction air shutter are in the initial state while the attraction belt 21 is stopped. If there is a shutter not in the initial state, the controller 60 sets the shutter to the initial state (step S1). The initial state of each of the side floating air shutter, the front floating air shutter, the separation air shutter, and the upward suction air shutter is "open (in open state)", while the initial state of the downward suction air shutter is "closed (in closed state)". As is described later, since the shutter is initialized and the feeding operation is terminated, each shutter is normally in the initial state at the start of the feeding operation.

Next, the controller 60 causes the blowing fans of the side floating air, the front floating air, and the separation air, the belt attraction fan of the upward suction air, and the downward suction fan of the downward suction air to operate. Then, the controller 60 executes a preliminary separating operation for 5 seconds (step S2). In the present embodiment, the preliminary separating operation is executed for 5 seconds. Note that the time of the preliminary separating operation is not limited to 5 seconds and may be appropriately set according to the configuration of the sheet feeding device.

During the preliminary separating operation, the side floating air shutter and the front floating air shutter are opened. Accordingly, the side floating air and the front floating air are blown to the lateral sides and the front side of the upper portion of the bundle of sheets P. Thus, the first sheet being the uppermost sheet and several sheets of the second and subsequent sheets float among sheets in the upper portion of the bundle of sheets P. In the preliminary separating operation, since the separation air shutter is also opened, the first sheet is separated from the second and subsequent sheets by the separation air. Further, in the preliminary separating operation, the upward suction air shutter is also opened, thus causing the floated first sheet to be attracted to the attraction belt 21.

When the preliminary separating operation is terminated (after 5 seconds have passed from the start of the operation of each fan), the attraction belt 21 is rotated to feed the first sheet. At this time, if the second sheet excessively floats or disturbs the behavior and contacts the first sheet, the second sheet might be conveyed from the bundle of sheets P together with the first sheet. Hence, in the present embodiment, when the preliminary separating operation is completed, the front floating air shutter and the separation air shutter are closed to drop the floated second sheet so as not to contact the first sheet, thus suppressing the double feeding (step S3). Further, the downward suction air shutter is opened to start downward suction (step S4). The downward suction air shutter is closed until the preliminary separating operation is completed. Thus, in the preliminary separating operation, the first sheet can be favorably attracted to the attraction belt 21 without being disturbed by the downward suction air. With the above-described configuration, double feeding of the second sheet can be suppressed, and in the preliminary separating operation, the floating of the first sheet and the attraction of the sheet to the attraction belt are not disturbed by the downward suction air, thus allowing the first sheet to be favorably attracted to the attraction belt. Then, driving of a feeding motor is started to rotate the attraction belt on which the first sheet is attracted, thus starting sheet feeding (step S5).

When a predetermined time has passed from the start of feeding (when the leading end of the first sheet is fed to a predetermined subsequent step (for example, a pair of conveying rollers) downstream from the attraction belt 21, the upward suction air shutter is closed to release the first sheet attracted on the attraction belt 21 (step S6). Further, driving of the feeding motor is stopped to stop the attraction belt 21 (step S7).

Next, the controller 60 determines whether there is a sheet to be fed (step S8). When there is a sheet to be fed (YES in step S8), the controller 60 causes the front floating air shutter to open to resume the blowing of the front floating air toward the front side of the upper portion of the bundle of sheets P. The controller 60 causes the separation air shutter to open and resumes the blowing of the separation air (step S9).

Next, the controller 60 closes the downward suction air shutter and prevents the floating of the second sheet to be fed next from being disturbed by the downward suction air. The controller 60 opens the upward suction fan shutter to resume the attraction of the sheet to the attraction belt 21 (step S11). Thus, the second sheet can be favorably attracted to the attraction belt. Then, the process from steps S3 to S8 is performed to feed the sheet.

In step S8, steps S3 to S11 are repeated until the number of sheets fed reaches a set number. If the number of sheets fed reaches the set number and there is no sheet to be fed next (NO in step S8), in S12 the controller 60 causes each shutter to be set in the initial state, stops the operation of each fan, and terminates the feeding operation.

In the above-described feeding operation, the downward suction air shutter closed is opened at step S4 in accordance with the closing of the front floating air shutter and the separation air shutter in step S3. Accordingly, a negative pressure is generated by sucking air from the front of the first sheet by the downward suction air. Such a configuration can accelerate the falling speed of the second sheet, thus suppressing double feeding. In addition, as the feeding operation of the second sheet, the front floating air and the separation air are blown again to float and attract the second sheet to the attraction belt. However, to increase the productivity, unlike the preliminary separating operation, the controller 60 executes the operation of step S3 and subsequent steps immediately after the opening of the upward suction air shutter (without waiting 5 seconds). At this time, if the downward suction air shutter is opened, it might take a long time for the second sheet to float again. In such a case, the second sheet might be fed without being favorably attracted to the attraction belt, which might cause feeding failure. Therefore, in step S10, the downward suction shutter and stopping the downward suction air are closed to accelerate the re-floating speed of the second sheet, thus allowing the second sheet to be quickly and favorably adhered to the attraction belt. Accordingly, even if the operation of step S3 and subsequent steps is executed immediately after the opening of the upward suction air shutter (after waiting 5 seconds), the second and subsequent sheets can be favorably adhered to the attraction belt, thus suppressing feeding failure of the second and subsequent sheets.

In addition, immediately after the front floating air shutter or the separation air shutter are opened in the re-floating operation of the second sheet, the second sheet may jump up and contact the first sheet being conveyed, thus causing the double feeding of the first sheet with the second sheet. Hence, in the present embodiment, as illustrated in step S9 and step S10, the downward suction air shutter is closed after, for example, 50 ms to 150 ms has elapsed since the front floating air shutter is opened. As a result, the second sheet being about to jump up can be sucked downward by the downward suction air, thus suppressing the contact the second sheet with the first sheet being conveyed. Accordingly, the double feeding can be suppressed.

As described above, when the sheet is attracted to the attraction belt, the downward suction air shutter is closed to stop the action of the suction force to the sheet, thus allowing the sheet to be favorably floated. Accordingly, the feeding failure of the sheet can be suppressed.

Note that, in the present embodiment, as an example of the switching device, a mechanism has been described above in which the shutter is slid by switching the solenoid to the non-energized state or the energized state to switch the shut-off or release of the air. However, embodiments of the present disclosure are not limited to the example. For example, the switching device may be a mechanism in which a butterfly valve, which is a disc-shaped valve body having a diameter equal to the inner diameter of a cylindrical ventilation passage, is disposed in the cylindrical ventilation passage and the butterfly valve is rotated around a diameter axis to shut off or open the inside of the ventilation passage. Alternatively, a ventilation passage is formed with, e.g., a flexible resin, and the ventilation passage is pressed from the outside to compress the ventilation passage to shut off the ventilation in the ventilation passage or release the pressure from the outside to release the ventilation. In the above-described embodiment, the structure in which the sheet is attracted to the feeding belt (attraction belt) by the negative pressure is used for a feeder. Note that embodiments of the present disclosure are not limited to the structure. For example, a structure may be employed in which the sheet is electrostatically attracted to the feeding belt by static electricity.

The above-described embodiments are limited examples and, for example, the following aspects of the present disclosure may have advantageous effects described below.

Aspect A

A sheet feeding device, such as the sheet feeding device 200, includes a sheet stacking table, such as the sheet stacking table 11, to stack a bundle of sheets; an air blower, such as the air blowing device 24, to blow air to the bundle of sheets to float an uppermost sheet from the bundle of sheets; a feeder, such as the feeding unit 20, to feed the uppermost sheet; and an air sucker, such as the downward suction device 25, to suck air in such a direction that a sheet in vicinity of the uppermost sheet moves away from the feeder. The air sucker includes a suction nozzle, such as the downward suction nozzle 25*a*, to suck air; a suction fan, the downward suction fan 42, to generate a negative pressure; a suction duct, the downward suction air chamber 33, to communicate the suction nozzle with the suction fan; and an opening-and-closing mechanism, such as the downward suction shutter 34, to shut off and release ventilation in the suction duct. For example, in a configuration in which air suction cannot be shut off when air suction is unnecessary, the following problems might occur. That is, when the uppermost sheet is floated from the bundle of sheets P by blowing air, the action of the air blowing on the uppermost sheet is also hindered by the air suction of the suction nozzle. As a result, it might take time for the uppermost sheet to be attracted to the attraction belt, causing a delay in feeding of the sheet, or the uppermost sheet might not be attracted to the attraction belt, causing non-feeding of the sheet. According to the present aspect, ventilation in the suction duct can be shut off by the opening-and-closing mechanism. Thus, air suction can be shut off when air suction is unnecessary. Therefore, during the air blowing period in which air is blown by the air blower, for example, an air suction stop period during which the air suction operation by the air sucker is stopped is provided. In the air suction stop period, the action of the blowing air for separating the uppermost sheet from the bundle of sheets P is not hindered. Therefore, the uppermost sheet can be separated from the bundle of sheets P without being disturbed by the air suction operation, thus suppressing sheet feeding delay due to the air suction operation and non-feed of the sheet.

Aspect B

The sheet feeding device according to aspect A further includes control circuitry, such as the controller 60, to cause the opening-and-closing mechanism to switch shut-off and release of the ventilation in the suction duct. The control circuitry is to cause the opening-and-closing mechanism to shut off the ventilation in the suction duct for a period of time, while the air blower blows air. The control circuitry is to cause the opening-and-closing mechanism to release the ventilation in the suction duct for a period of time, while the air blower does not blow air. According to the present aspect, in the period during which the air suction is stopped, the action of the blowing air for separating the uppermost sheet from the bundle of sheets P is not hindered. In the air suction period, other sheets can be separated from the uppermost sheet attracted to the attraction belt, thus suppressing double feeding. Therefore, the uppermost sheet can be separated from the bundle of sheets P without being disturbed by the air suction operation, thus suppressing sheet feeding delay due to the air suction operation and non-feed of the sheet.

Aspect C

In the sheet feeding device according to aspect B, the control circuitry is to cause the opening-and-closing mechanism to release the ventilation in the suction duct after an elapse of a predetermined period of time from when the air blower stops blowing air. According to the present aspect, the stop of the action of the force moving in the direction away from the feeder is delayed by a predetermined time. Accordingly, an excessively floated sheet can be attracted toward the sheet stacking table by the action of the force directed away from the feeder to reliably suppress excessive floating of the sheet, thus suppressing feeding failure.

Aspect D

In the sheet feeding device according to any one of the above-described aspects A to C, the suction nozzle is arranged so that a projecting end of the suction nozzle is arranged to contact, in a height direction, a leading end of a sheet fed subsequently to the uppermost sheet to regulate feeding of the sheet. According to the present aspect, a failure can be reduced that a sheet is caught by the projecting end of the suction nozzle to cause a feeding failure.

Aspect E

In the sheet feeding device according to any one of the above-described aspects A to D, a projecting end of the suction nozzle is arranged to suck the uppermost sheet at a position close to the uppermost sheet in a height direction. According to the present aspect, a portion close to the uppermost sheet is sucked by the suction nozzle, thus enhancing the effect of separating the uppermost sheet from other sheets. Further, other sheets approaching the uppermost sheet is quickly sucked to release the other sheets quickly from the uppermost sheet, thus suppressing double feeding in a short time and allowing sheets to be fed one by one at high speed.

Aspect F

The sheet feeding device according to any one of the above-described aspects A to E includes an adjuster to adjust a position of the suction nozzle in a height direction. According to the present aspect, the suction position can be adjusted, and the adjustment of the suction position can reduce variations in the sheet feeding device.

Aspect G

In the sheet feeding device according to any one of the above-described aspects A to F, at least a contact portion of the suction nozzle to contact the sheet is subjected to surface treatment to reduce abrasion. According to the present aspect, deterioration of the suction nozzle can be suppressed, thus allowing extension of the product life of the sheet feeding device.

Aspect H

The sheet feeding device according to any one of the above-described aspects A to G includes a sheet surface sensor, such as the sheet top sensor 41, in vicinity of the suction nozzle to detect an uppermost position of the bundle of sheets. According to the present aspect, the stop position at the time of raising and lowering the sheet stacking table is detected using the upper surface of the sheet and the sheet surface sensor. If air enters between sheets and the sheets are floating, accurate detection of the upper surface may be hampered. Hence, the uppermost sheet is dropped toward the bundle of sheets P side by the action of the suction force by the suction nozzle, thus allowing accurate detection of the height of the upper surface of the uppermost sheet of the bundle of sheets P.

Aspect I

An image forming apparatus, such as the image forming apparatus 100, includes an image forming device, such as the image forming units 111Y, 111M, 111C, and 111K, to form an image on a sheet; and the sheet feeding device, such as the sheet feeding device 200, according to any one of aspects A to H to feed the sheet toward the image forming device. According to the present aspect, an image forming apparatus can be provided that is capable of suppressing occurrence of feeding failure.

Aspect J

An image forming system, such as the image forming system 1, includes an image forming apparatus, such as the image forming apparatus 100, including an image forming device, such as the image forming units 111Y, 111M, 111C, and 111K, to form an image on a sheet; and the sheet feeding device, such as the sheet feeding device 200, according to any one of aspects A to H to feed the sheet toward the image forming apparatus. According to the present aspect, an image forming system can be provided that is capable of suppressing occurrence of feeding failure.

Numerous additional modifications and variations are possible in light of the above teachings. It is therefore to be understood that, within the scope of the above teachings, embodiments of the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeding device comprising:

a sheet stacking table to stack a bundle of sheets;

an air blower to blow air to the bundle of sheets to float an uppermost sheet, of the bundle of sheets, from other sheets of the bundle of sheets;

a feeder to feed the uppermost sheet;

an air sucker to suck air in direction to move a sheet in a vicinity of the uppermost sheet, away from the feeder, the air sucker including:

a suction nozzle to suck the air;

a suction fan to generate a negative pressure;

a suction duct to communicate the suction nozzle and the suction fan; and an opening-and-closing mechanism to shut off and release ventilation in the suction duct; and control circuitry to cause the opening-and-closing mechanism to switch shut-off and release of the ventilation in the suction duct, wherein the control circuitry is configured to cause the opening-and-closing mechanism to shut off the ventilation in the suction duct for a period of time, during which the air blower blows air, and wherein the control circuitry is configured to cause the opening-and-closing mechanism to release the ventilation in the suction duct for a period of time, during which the air blower does not blow air.

2. The sheet feeding device of claim 1, wherein the control circuitry is configured to cause the opening-and-closing mechanism to release the ventilation in the suction duct after an elapse of a period of time beginning when the air blower stops blowing air.

3. The sheet feeding device of claim 2, wherein a projecting end of the suction nozzle is arranged to contact, in a height direction, a leading end of a sheet, of the bundle of sheets, fed subsequently to the uppermost sheet to regulate feeding of the sheet.

4. An image forming apparatus comprising:

an image forming device to form an image on a sheet; and the sheet feeding device of claim 3 to feed the sheet toward the image forming device.

5. An image forming apparatus comprising:

an image forming device to form an image on a sheet; and the sheet feeding device of claim 2 to feed the sheet toward the image forming device.

6. The sheet feeding device of claim 1, wherein a projecting end of the suction nozzle is arranged to suck the uppermost sheet at a position proximate to the uppermost sheet in a height direction.

7. The sheet feeding device of claim 1, wherein a contact portion of the suction nozzle, to contact the sheet, is subjected to surface treatment to reduce abrasion.

8. The sheet feeding device of claim 1, further comprising:

a sheet surface sensor, in a vicinity of the suction nozzle, to detect an uppermost position of the bundle of sheets.

9. An image forming apparatus comprising:

an image forming device to form an image on a sheet; and the sheet feeding device of claim 1 to feed the sheet toward the image forming device.

10. An image forming system comprising:

an image forming apparatus including an image forming device to form an image on a sheet; and the sheet feeding device of claim 1 to feed the sheet toward the image forming apparatus.

11. The sheet feeding device of claim 1, wherein the control circuitry is configured to control the opening-and-closing mechanism to close after 50 ms to 150 ms has elapsed since the opening-and-closing mechanism has been opened.

12. An image forming apparatus comprising:

an image forming device to form an image on a sheet; and the sheet feeding device of claim 11 to feed the sheet toward the image forming device.

* * * * *